US010781779B2

(12) United States Patent
Ijsselstein

(10) Patent No.: US 10,781,779 B2
(45) Date of Patent: Sep. 22, 2020

(54) FUEL INJECTION DEVICES

(71) Applicant: Cereus Technology B.V., Eerbeek (NL)

(72) Inventor: Tjeerd Sijtse Ijsselstein, BG Meeden (NL)

(73) Assignee: T.D.C. PRODUCTS B.V., Meeden (NL)

( * ) Notice: Subject to any disclaimer, the term of this patent is extended or adjusted under 35 U.S.C. 154(b) by 0 days.

(21) Appl. No.: 16/085,882

(22) PCT Filed: Mar. 17, 2017

(86) PCT No.: PCT/NL2017/050166
§ 371 (c)(1),
(2) Date: Sep. 17, 2018

(87) PCT Pub. No.: WO2017/160149
PCT Pub. Date: Sep. 21, 2017

(65) Prior Publication Data

US 2019/0093618 A1 Mar. 28, 2019

(30) Foreign Application Priority Data

Mar. 18, 2016 (NL) ..... 1041770

(51) Int. Cl.
*F02M 63/00* (2006.01)
*F02M 61/18* (2006.01)

(52) U.S. Cl.
CPC ..... *F02M 63/0038* (2013.01); *F02M 61/18* (2013.01); *F02M 61/182* (2013.01);
(Continued)

(58) Field of Classification Search
CPC ..... F02M 63/0038; F02M 63/004; F02M 63/0056; F02M 61/18; F02M 61/1806;
(Continued)

(56) References Cited

U.S. PATENT DOCUMENTS 3,339,848 A * 9/1967 Geiger ..... F02M 45/086 239/453
3,559,892 A * 2/1971 De Luca ..... F02M 45/08 239/533.4
(Continued)

FOREIGN PATENT DOCUMENTS

DE 19645201 6/1997
DE 10007659 9/2001
(Continued)

*Primary Examiner* — Thomas N Moulis
(74) *Attorney, Agent, or Firm* — Occhiuti & Rohlicek LLP

(57) ABSTRACT

An improved fuel injection device for internal combustion engines comprising a slidable (pilot) valve instead of a needle valve principle. The valve does not comprise a seat, so, even in the case of a spring-loaded embodiment of the valve there is no risk of hammering of the valve on a seat with the pertaining generation of noise.
The improved fuel injector allows a larger nozzle diameter and, therefore, a larger number of nozzle holes, if required or deemed useful.
For rotating embodiments of the fuel injector, the valve or at least its spring, in the case of a spring-loaded embodiment of the valve, can be located in the static section of the rotating fuel injector, thus eliminating the balancing problem of prior art rotating fuel injectors which comprise a spring in the rotating section.

17 Claims, 6 Drawing Sheets

(52) U.S. Cl.
CPC ..... *F02M 61/1846* (2013.01); *F02M 2200/09* (2013.01); *F02M 2200/29* (2013.01)

(58) Field of Classification Search
CPC ..... F02M 61/182; F02M 61/1826; F02M 61/1846; F02M 2200/29
See application file for complete search history.

(56) References Cited

U.S. PATENT DOCUMENTS 3,995,813 A * 12/1976 Bart ..... F02M 47/043 239/584
4,342,443 A * 8/1982 Wakeman ..... F02M 51/0617 251/129.08
4,462,368 A * 7/1984 Funada ..... F02D 41/40 123/446
4,546,739 A * 10/1985 Nakajima ..... F02M 45/00 123/299
4,658,824 A * 4/1987 Scheibe ..... F02M 61/18 123/446
5,152,271 A 10/1992 Matsumura
5,588,412 A * 12/1996 Nozaki ..... F02M 61/182 123/496
5,826,801 A * 10/1998 Kobayashi ..... F02M 61/045 239/533.4
5,899,389 A * 5/1999 Pataki ..... F02M 45/086 239/533.2
5,947,389 A * 9/1999 Hasegawa ..... F02M 61/042 239/533.2
6,055,957 A * 5/2000 Hasegawa ..... F02D 41/40 123/305
6,220,528 B1 * 4/2001 Cooke ..... F02M 45/086 239/533.3
6,279,840 B1 * 8/2001 Buckley ..... F02M 45/086 239/533.12
6,412,712 B1 * 7/2002 Buckley ..... F02M 61/10 239/533.12
6,425,368 B1 * 7/2002 Lambert ..... F02M 45/00 123/300
6,513,733 B1 * 2/2003 Lambert ..... F02M 45/086 239/5
6,557,779 B2 * 5/2003 Perr ..... F02M 45/04 123/468
6,601,566 B2 * 8/2003 Gillis ..... F02M 43/00 123/467
6,616,070 B1 * 9/2003 Kunkulagunta ..... F02M 45/086 239/533.11
6,705,543 B2 * 3/2004 Carroll, III ..... F02M 45/04 239/124
6,725,838 B2 * 4/2004 Shafer ..... F02D 41/3035 123/300
6,758,407 B1 * 7/2004 Lambert ..... F02M 45/086 123/294
6,769,634 B2 * 8/2004 Brenk ..... F02M 45/086 239/444
7,086,377 B2 * 8/2006 Best ..... F02B 1/12 123/294
7,201,334 B2 * 4/2007 Sasaki ..... F02M 61/1813 123/305
8,322,635 B2 * 12/2012 Choi ..... F02D 41/30 239/533.2
8,496,191 B2 * 7/2013 Grant ..... F02M 45/086 239/423
8,925,524 B2 * 1/2015 Cooke ..... F02M 45/086 123/445
8,973,554 B2 * 3/2015 Park ..... F02M 45/086 123/299
9,835,124 B2 * 12/2017 Koeninger ..... F02M 61/1893
10,415,524 B2 * 9/2019 Stroia ..... F02M 61/045
2002/0000483 A1 * 1/2002 Shoji ..... F02B 23/0669 239/533.2
2005/0230501 A1 * 10/2005 Haas ..... F02M 45/08 239/533.3
2007/0199539 A1 * 8/2007 Lennox ..... F02D 19/0605 123/304
2009/0139487 A1 * 6/2009 Dingle ..... F02M 61/06 123/445
2010/0065021 A1 * 3/2010 Hayatani ..... F02M 51/0671 123/476
2016/0010610 A1 * 1/2016 Fujino ..... F02M 43/04 123/445
2017/0356383 A1 * 12/2017 Ito ..... F02M 61/1813
2018/0119599 A1 * 5/2018 Zhang ..... F02M 26/01

FOREIGN PATENT DOCUMENTS

DE 102012025051 6/2014
EP 0713004 5/1996
EP 1030054 8/2000
EP 1063416 12/2000
WO 20090075572 6/2009

* cited by examiner

FUEL INJECTION DEVICES

CROSS-REFERENCE TO RELATED APPLICATIONS

This application is the National Stage under 35 USC 371 of International Application No. PCT/NL2017/050166 filed on Mar. 17, 2017, which claims the priority of Dutch Application No. 1041770, filed on Mar. 18, 2016. The contents of both applications are hereby incorporated by reference in their entirety.

FIELD OF THE INVENTION

The present invention relates to improved fuel injection devices for internal combustion engines. Further, the invention relates to a system comprising such internal combustion engine, like a motorized vehicle.

BACKGROUND OF THE INVENTION

Fuel injection devices for internal combustion engines are known in the art. DE 19645201 describes a fuel injection system with a pressurised feed to an injection jet at the end of an adjustable support. This may vary the injection depth inside the cylinder as well as the rotational alignment of the jet. The jet position is controlled by a control system and a servo drive. A common-rail pressurised fuel supply and a switching control provides the fuel pulses for each jet. The axial position of the jet is adjusted by the control system to give best efficiency coupled with lowest emission products. The spark plug position is also adjustable.

DE 10007659 describes an engine with an injector per cylinder protruding into a combustion chamber in the cylinder bounded by a piston to inject a fuel jet to form an ignitable air/fuel mixture with separately delivered combustion air and an ignition plug for igniting the mixture. The relative position of the ignition plug electrodes and the fuel jet can be adjusted by a control unit depending on the operating point of the engine.

NL2001069 describes a device with an injection part driven by an actuator to rotate with respect to a housing about a central axis. A supply conduit is connected to a combustion chamber for pressurized introduction of fuel into the chamber, and has a fluid-tight coupling between the housing and the injection part. An injection nozzle is rigidly connected to the injection part. An atomizer has an atomizer opening connected to the supply conduit, when the injection nozzle rotates.

SUMMARY OF THE INVENTION

The fuel injectors for internal combustion engines according to the prior art in general utilize a spring loaded needle with a mating seat, situated close to the tip or nose of the injector to control the fuel dosage to the nozzle holes in the tip through which the fuel enters the combustion chamber of an engine.

Such prior art fuel injectors tend to have a number of drawbacks, such as a high noise level due to oscillation of the spring loaded needle and the fixed number of nozzle holes through which fuel enters the combustion chamber irrespective of the power demand, hence, irrespective of the amount of fuel that is injected per injection cycle.

Due to the inherently small diameter of the nozzle tip of this type of prior art fuel injector the number of nozzle holes that can be made along the circumference of the tip is limited. The aforementioned disadvantages will be experienced with almost every type of fuel injector according to the prior art, i.e. both prior art static fuel injectors and prior art rotating fuel injectors.

In addition to the drawbacks mentioned above, prior art rotating fuel injectors with a spring loaded needle have at least two further disadvantages, which will be explained below.

Rotational injection of fuel into a combustion chamber of an internal combustion engine will promote complete combustion of the fuel, thereby reducing the fuel consumption and the pertaining $CO_2$ emission. In addition, it will limit or even prevent the formation and emission of, particulate matter (PM) and thermal $NO_x$.

The Dutch patent NL 2001069 describes a rotating fuel injector for internal combustion engines which proposes to tackle the emissions of internal combustion engines. This prior art rotating fuel injector in principle comprises a prior art needle type static fuel injector that is brought into rotation for the injection of fuel into a combustion chamber. Such fuel injectors with a spring loaded needle for dosage of the fuel that will be injected into a combustion chamber through nozzle holes in the tip of the injector comprise parts that require a very close fit, yet at the same time they comprise a spring that requires substantial lateral clearance in order to function properly. In view of the high rotational speed (for example in the range of 20.000 to 100.000 rpm) that is needed to obtain all the desired benefits of rotating fuel injection, proper balancing of the rotating fuel injector is essential. If such an injector includes a spring with the lateral clearance that it needs, proper balancing becomes a difficult if not impossible task.

A not properly balanced rotating fuel injector may experience a higher wear rate and, therefore, a shorter MTBF (mean time between failures) and may produce more noise. The latter, of course, is also undesirable.

As pointed out above, the nozzle tip of a prior art rotating fuel injector with a spring loaded needle valve for the control of the fuel injection has a small diameter. This means that upon rotation of the nozzle, the nozzle hole exit openings which are positioned in the nozzle tip will have a relatively low peripheral speed, while for effective mixing of fuel and combustion air a higher peripheral speed is desirable or even required. In order to achieve this with a prior art rotating fuel injector with the pertaining small nozzle tip, very high rotational speeds of the fuel injector are required.

It is an objective of the invention to provide an alternative fuel injection device that preferably further at least partly obviates one or more of above-described drawbacks. It is a further aspect to provide a system comprising an internal combustion engine comprising an alternative fuel injection device. The present invention may have as object to overcome or ameliorate at least one of the disadvantages of the prior art, or to provide a useful alternative.

Hence in a first aspect, the invention provides an injection device ("device") for injecting a fuel into a combustion chamber of an internal combustion engine, wherein the device comprises a sleeve and a valve, and especially wherein the valve is configured movable, especially slidable, in an axial direction in the sleeve. The valve, especially comprises a sliding configuration. The valve may move axially inside the sleeve (during operation of the device). The valve may provide a closed and an open position, especially arranged at different axial locations in the sleeve. The valve may comprise a plunger or a piston, which may translate in the sleeve. The valve may be actuated, e.g. by a pressure, especially being provided by a fuel. The valve especially comprises a pilot valve. Especially, the valve is a pilot valve. In the remainder of the description, the valve is referred to as pilot valve. This, however, does not exclude other types of valves having the same structural features as described below in relation to the pilot valve. Hence, especially the valve according to the invention is named a pilot valve. The terms "pilot valve" and "valve according to the invention" may especially be used interchangeably herein.

The improved fuel injector device (also referred herein as "assembly") according to the invention comprises a pilot valve instead of a needle valve principle. The valve does not comprise a seat, so, even in the case of a spring loaded embodiment of the pilot valve there is no risk of hammering of the valve on a seat with the pertaining generation of noise. Herein, the terms "fuel injector", "fuel injector device", "fuel injection device", and "injection device" may be used interchangeably. These terms may all relate to the device according to the invention.

The improved fuel injector according to the invention allows a larger nozzle diameter and, therefore, a larger number of nozzle holes, if required or deemed useful. The fuel injector may especially advantageously be used (arranged) in a diesel engine. Herein the term "hole" such as in "nozzle hole" especially relates to a "through hole". Especially, a nozzle hole is configured to provide a flow channel for a fuel.

For rotating fuel injectors according to the present invention, the pilot valve or at least its spring, in the case of a spring loaded embodiment of the valve, can be located in the static section of the rotating fuel injector, thus eliminating the balancing problem of prior art rotating fuel injectors which comprise a spring in the rotating section. The sleeve may comprise one or more nozzle holes. In embodiments, the sleeve comprises one or more nozzle holes in the vicinity of one end of the sleeve. In further embodiments, an angle between a longitudinal axis of at least one nozzle hole and an axis of the sleeve is selected in the range of 0-90 degrees, such as in the range of 45-90 degrees, especially in the range of 50-80 degrees. In other embodiments the angle is selected in the range of 0-45°, especially 0-30°. Optionally, also combinations of holes with different angle may be applied.

Herein, the term nozzle hole may also relate to more than one (different) nozzle holes. By virtue of the larger nozzle diameter the rotating speed of the fuel injector can be lower than that of a prior art rotating fuel injector for achievement of the same peripheral speed of a rotating nozzle hole exit. In embodiments, at least one of the nozzle holes has a diameter of less than or equal to 50 micrometers, especially less than or equal to 30 micrometers. Herein, the term "nozzle diameter" especially relates to a diameter of the sleeve. The terms "nozzle diameter" and "sleeve diameter" may be used interchangeably.

In an embodiment the sleeve comprises a rotatable sleeve, especially configured rotatably in the device about a (longitudinal) axis of the (rotatable) sleeve (see also below). In embodiments, the device further comprises an impeller. Especially the impeller is rigidly connected to the rotatable sleeve. Especially, the impeller is configured in rigid contact with the rotatable sleeve.

In a further embodiment, the pilot valve comprises a rotatable pilot valve, especially configured rotatably in the device about an axis of the pilot valve.

In embodiments, the pilot valve comprises two fuel chambers and a fuel channel (arranged between the two fuel chambers). Especially, the fuel channel is configured in fluid contact with each of the two fuel chambers (see also below).

In a further aspect, the invention provides a system comprising an internal combustion engine, wherein the internal combustion engine comprises the injection device described herein. The system may be a motorized vehicle, such as a car, a motor cycle, a truck, etc. The system may also comprise a motorized vessel, aircraft, power generator set, etc. In embodiments, the combustion engine may especially comprise a diesel engine.

BRIEF DESCRIPTION OF THE DRAWINGS

The objects and advantages of the present invention will become more apparent from the following description when taken in conjunction with the accompanying drawings, in which:

FIG. 1(*b*) is a schematic longitudinal section of an embodiment of a static fuel injector according to the invention with the pilot valve in the fully opened position;

Identical or similar parts have been designated with identical or similar reference numbers in all drawings.

The schematic drawings are not necessarily to scale.

DETAILED DESCRIPTION OF THE INVENTION

Figure 1:
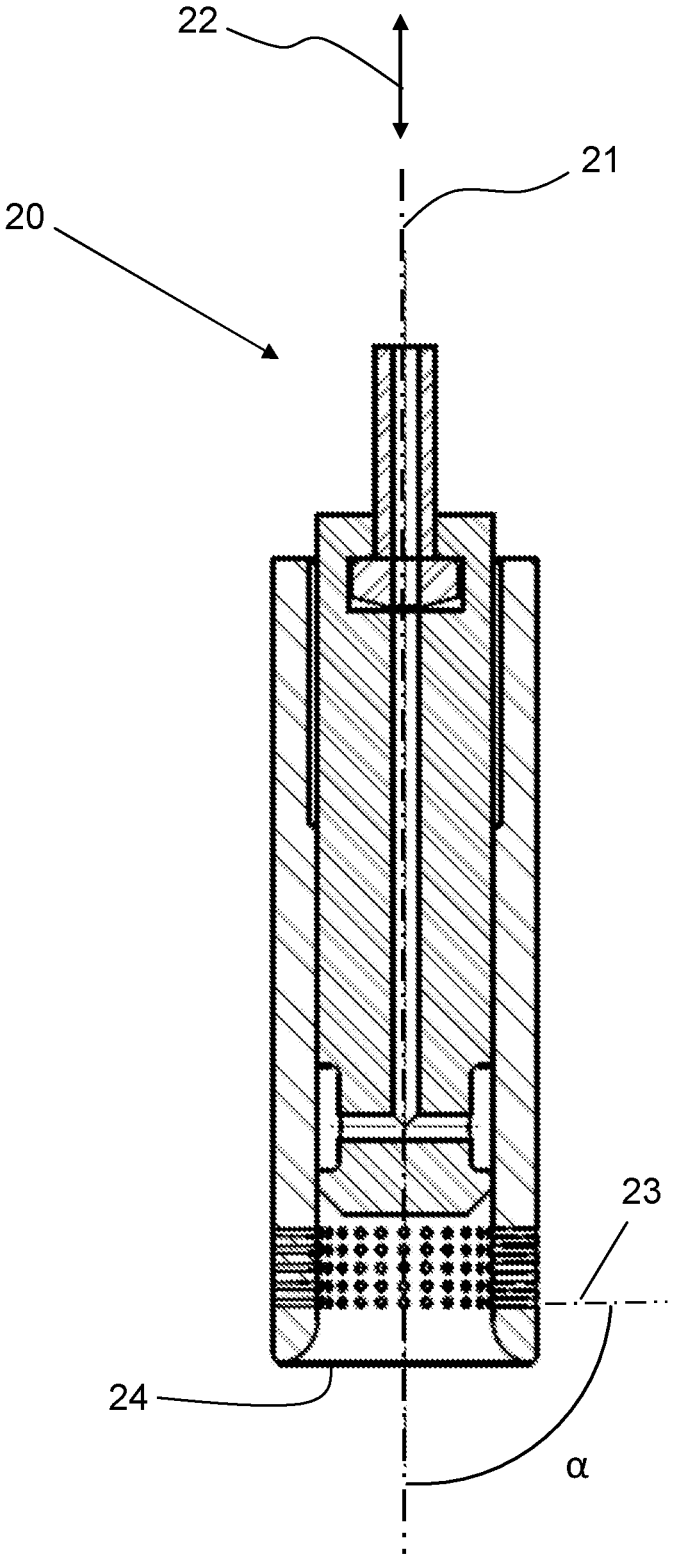
FIG. 1(*a*) is a schematic longitudinal section of an embodiment of the main (injection related) parts of the fuel injection device (assembly)
Figure 1:
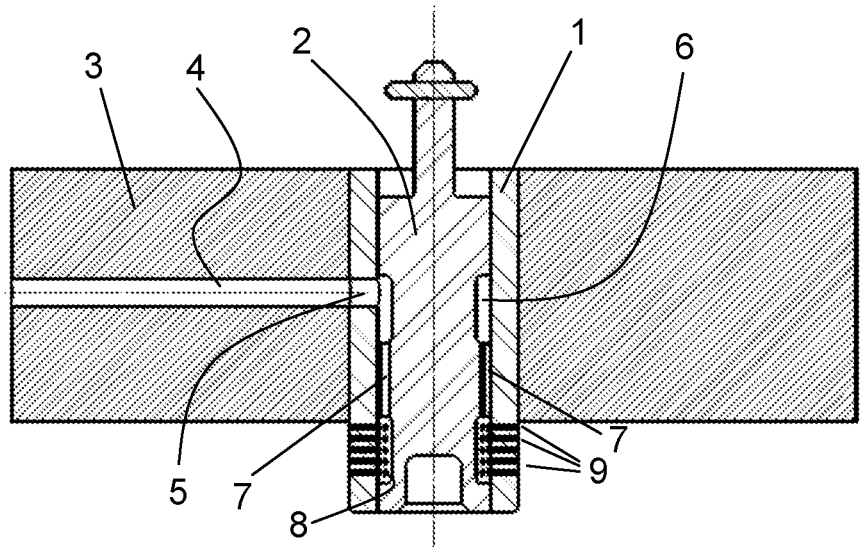

Amongst others, it is an objective of the present invention to provide a fuel injector device (assembly), either static or rotatable, which does not include a, spring loaded or otherwise actuated, needle valve in the injector tip as the fuel dosing control means. FIG. 1(*a*) is a schematic longitudinal section of an embodiment of the main (injection related) parts (the sleeve 1, and the valve 2, see e.g. FIG. 1(*b*) for the respective reference numbers) of the fuel injection device (assembly) 20, hereinafter also referred to as the fuel injector device 20, according to the invention. In this embodiment the axes 21 of the sleeve 1 and the axis of the pilot valve (the axis of the respective main parts) coincide. In the figure also the angle $\alpha$ between the axis 21 of the sleeve and the axis 23 of a nozzle holes is schematically depicted. The nozzle holes are depicted at an end 24 of the sleeve (see also FIG. 7).

FIG. 1(*b*) is a schematic longitudinal section of an embodiment of a static fuel injector according to the invention with the pilot valve in the fully opened position. In this embodiment the static fuel injector comprises a sleeve 1 and a pilot valve 2 which can move in the sleeve axially, as also depicted schematically by the arrow 22 in FIG. 1(*a*), with a close, essentially fuel tight, fit. The sleeve 1 is installed statically in the cylinder head 3 (see FIG. 1(*b*)) of an engine, such that the exit opening of the fuel supply conduit 4 in the cylinder head coincides with the inlet opening 5 in the sleeve 1 of the fuel injector. In the position of the pilot valve shown in FIG. 1(*b*), the first fuel chamber 6 of the pilot valve is positioned to receive fuel through the inlet opening 5 in the sleeve. Subsequently the fuel flows from the first fuel chamber 6 through a channel 7 to the second fuel chamber 8 of the pilot valve. In the fully opened position of the pilot valve shown in FIG. 1(*b*) the second fuel chamber 8 is in fluidic connection with all the fuel injection nozzle holes 9 of the sleeve 1. Due to the resolution of the drawings the depiction of nozzle holes 9 may in some cases resemble one bold line instead of two separate parallel lines. In this embodiment the sleeve comprises 5 stacked rows of nozzle holes, wherein each row comprises an array of nozzle holes along the circumference of the sleeve. In the embodiments, the nozzle holes 9 are aligned in the rows. In further embodiments, the nozzle holes 9 may be staggered (see e.g. FIG. 8 and FIG. 9). The fuel injector of an internal combustion engine is often also referred to as an atomizer, since ideally it should distribute/atomize the fuel as finely as possible. The larger the number of nozzle holes and the smaller the diameter of these holes, the smaller the injected fuel packets and hence the finer and better the fuel distribution will be. Prior art fuel injectors were very limited in the number of nozzle holes due to the limited size of the nozzle tip or nose. Therefore, in order to be able to inject sufficient fuel when demanded, the diameter of the nozzle holes of such prior art fuel injectors had to be relatively large, for example 0.1 to 0.2 millimeters. The dimensions of the sleeve of the fuel injector according to the present invention offers the possibility to create a large number of nozzle holes. In view of their large number the diameter of each nozzle hole can be much smaller than that of the nozzle holes of prior art fuel injectors. This means that the fuel injector according to the present invention will be able to atomize the fuel very effectively, creating very small fuel packets which facilitates further evaporation, mixing and ignition.

Contrary, to the prior art needle type fuel injectors, in which all the nozzle holes are either opened for fuel to exit through them or closed, the fuel injector according to the invention offers the possibility to close some of the nozzle holes 9 while the other nozzle holes remain open. This is achieved by moving the pilot valve 2 from the position shown in FIG. 1(*b*) upward until the second fuel chamber 8 is in fluidic connection with for example only the three top rows of injection nozzle holes 9 and the two bottom rows of nozzle holes are closed by the wall of the pilot valve. In that case fuel is still injected through the nozzle holes 9 of the three top rows of nozzle holes. The fuel injector according to the present invention enables controlling the number of nozzle holes through which fuel enters the combustion chamber depending on the power demand. Please note that the schematic drawing in FIG. 1(*b*) is not to scale.

In an embodiment of the fuel injector according to the invention the stroke of the pilot valve between the fully opened and the fully closed position involves a distance of only approximately 0.3 millimeters. Such an embodiment of the fuel injector may comprise nozzle holes with a diameter of for example only 0.05 millimeters or even smaller (for example in the range of 0.020 to 0.025 millimeters), wherein the nozzle holes may be staggered to minimize the required distance between two successive rows of nozzle holes. Of course, in order to prevent blockage, it is important to assure that the nozzle hole diameters are larger than the mesh of the fuel filter. The present invention also includes embodiments of the fuel injector in which a single fuel injector comprises nozzle holes with different diameters.

A small stroke of the pilot valve between the fully opened and fully closed position enables accurate dosage if used in combination with a fast response actuator.

The application of the present fuel injector comprising a pilot valve offers the possibility for function dependent axial positioning of the pilot valve, i.e. positioning as a direct function of the power demanded by the pertaining cylinder of the engine. So, the pilot valve offers both an accurate control and a regulating function on a per cylinder base. This can also be very useful as an override. With the prior art fuel injection systems the control function was restricted to control of the flow by means of a pump and/or solenoid valve, usually for all cylinders combined, but never involved the direct operation of the injection nozzle itself.

In the case of an engine with prior art fuel injectors that experiences problems in one cylinder, for example due to malfunctioning (e.g. leakage) of an exhaust valve, the operator usually has no other option than to shut down that cylinder. Unlike the prior art fuel injection system, the fuel injectors according to the present invention can be coupled to the on-board diagnostic system (OBD), which instead of shutting down that cylinder can reduce the power of that cylinder with X %, by direct control at the pilot valve. The power shortage of X % can be supplemented by the remaining, fully functional cylinders, through the engine speed control.

The application of the fuel injector according to the present invention is not limited to engines with liquid fuel, but is also suitable for gas engines. However, in the latter application the fuel injector nozzle holes, especially the diameter of the nozzle holes, will have to be larger in order to accommodate the amount of gas that has to be injected. Due to the lower calorific value of gas compared to liquid fuels the volume of gas that has to be injected in a gas engine is much larger than the volume of liquid fuels in a liquid fuel fired engine with the same power rating.

Figure 2:
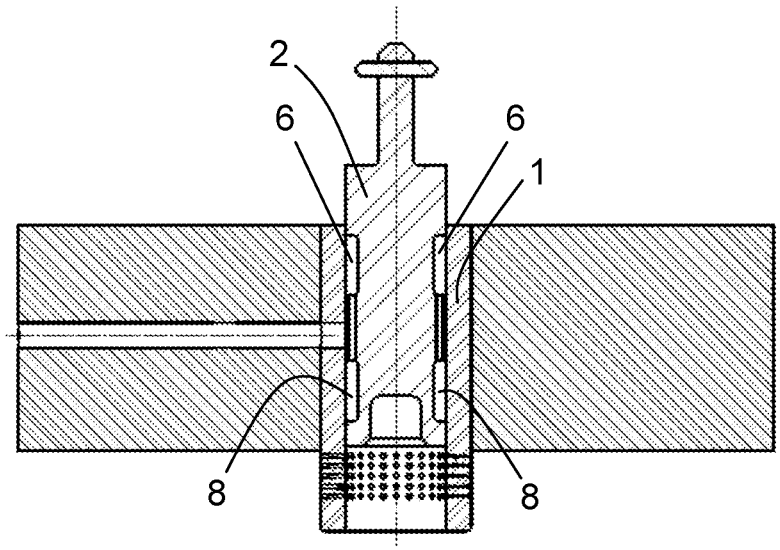
FIG. 2 is a schematic longitudinal section of an embodiment of a static fuel injector according to the invention with the pilot valve in the closed position.

Although it is not shown in FIG. 1(*b*) the invention includes embodiments of the fuel injector in which the nozzle holes 9 may be placed at two or more different angles relative to the axis of the sleeve. The fuel will then also exit at different angles, thus promoting a more uniform distribution of the fuel across the combustion chamber. This will be of particular importance for the static embodiments of the fuel injector according to the invention. FIG. 2 is a schematic longitudinal section of an embodiment of a static fuel injector according to the invention with the pilot valve in the fully closed position. In this position the first fuel chamber 6 and the second fuel chamber 8 of the pilot valve 2 are facing parts of the wall of the sleeve 1 with no fluid openings.

Figure 3:
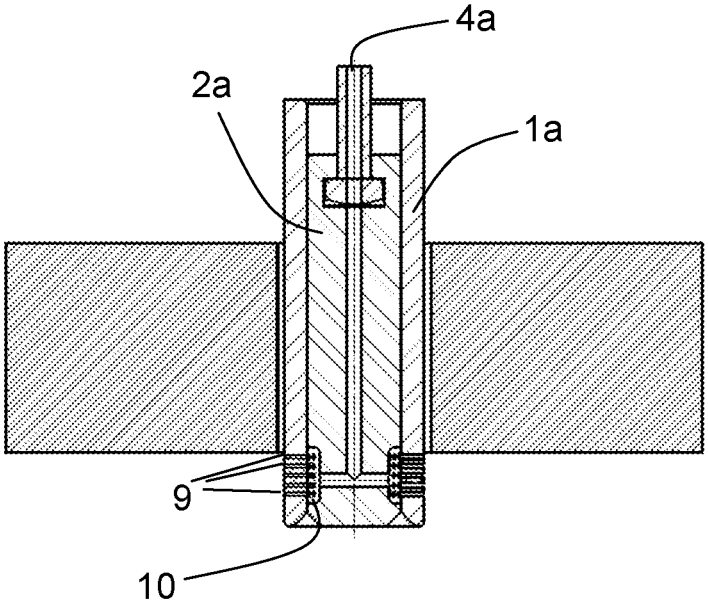
FIG. 3 is a schematic longitudinal section of an embodiment of a rotating fuel injector according to the invention with the pilot valve in the fully opened position.

FIG. 3 is a schematic longitudinal section of an embodiment of a rotating fuel injector according to the invention with the pilot valve in the fully opened position. In this embodiment the rotating or rotary fuel injector according to the invention comprises a rotatable sleeve 1*a* with injection nozzle holes 9 in the lower end of the sleeve, the end that protrudes into the combustion chamber. Especially, the fuel injector comprises a rotating fuel injector. In an embodiment the rotating fuel injector further comprises a pilot valve 2*a* with a fuel conduit 4*a* essentially coinciding with the axis of the pilot valve. At the top end the conduit 4*a* is connected fluidically with the fuel supply system (not shown in FIG. 3) and at the lower end it has one or more fluidic connections with the fuel chamber 10. The rotation of the sleeve can be effectuated in any suitable fashion and by any suitable means.

In FIG. 3, the nozzle holes 9 of the rotating sleeve 1*a* are shown as being perpendicular to the axis of the sleeve. However, the invention includes embodiments of the rotating fuel injector in which the nozzle holes are made at an angle to the axis of the sleeve. Although the rotation of the fuel injector already enables intensive mixing between the fuel and the combustion air, the angle of the nozzle holes may still provide added benefits.

One additional advantage of the rotating fuel injector according to the invention is the fact that, contrary to most static prior art fuel injectors, no residual fuel is left in the nozzle holes. Residual fuel in the nozzle holes of a fuel injector of an internal combustion engine may be released through the exhaust and may therefore contribute to the total emission of non-methane hydrocarbons (NMHC). Owing to the absence of residual fuel, the fuel injector according to the invention prevents this.

The invention comprises embodiments of the rotating fuel injector in which both the sleeve 1*a* and the pilot valve 2*a* rotate when the fuel injector is operational, but it also includes embodiments in which the pilot valve 2*a* does not rotate while the sleeve is rotating.

While the embodiments of the rotatable fuel injector referred to above comprise rotatable fuel injectors wherein the sleeve and the pilot valve rotate simultaneously and do not rotate relative to each other when the rotating fuel injector is operational, the invention also includes embodiments in which the pilot valve does not rotate, especially is not configured rotatable, while the sleeve is rotating when the injector is operational.

Hence, in the latter embodiments the sleeve rotates relative to the pilot valve. Hereinafter, such an embodiment of the rotating or rotatable fuel injector may be referred to as a rotating or rotatable fuel injector with a static pilot valve. Although a static pilot valve of such an embodiment does not rotate, it may still move axially.

In embodiments of the rotating fuel injector according to the invention with a spring loaded pilot valve, the spring is preferably located in the non-rotary part of the fuel injector in order to prevent balancing problems or challenges.

Figure 4:
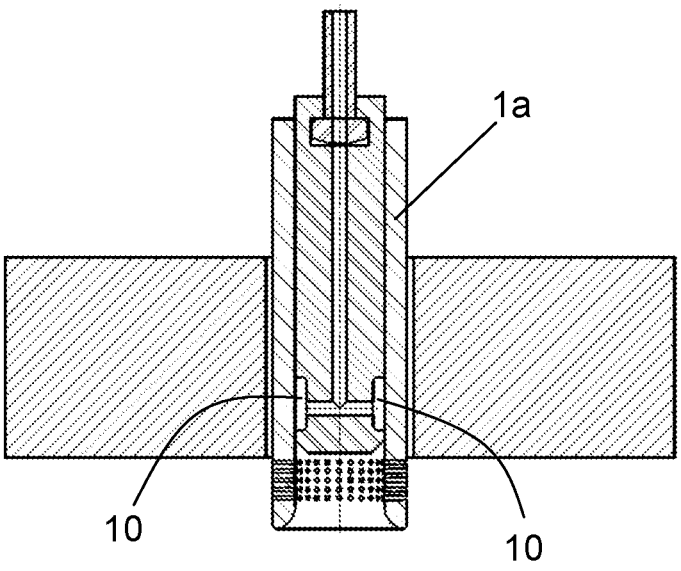
FIG. 4 is a schematic longitudinal section of an embodiment of a rotating fuel injector according to the invention with the pilot valve in the closed position.

FIG. 4 is a schematic longitudinal section of an embodiment of a rotating fuel injector according to the invention with the pilot valve in the closed position. This figure is self-explanatory.

Although the embodiments of the fuel injectors as shown in the attached figures all comprise 5 stacked rows of nozzle holes, the invention allows any suitable number of nozzle holes, any suitable number of rows, and any suitable layout pattern of the nozzle holes. In embodiments, the injector comprises at least 1, especially at least 3, such as at least 5, especially at least 7 rows of nozzles. Especially, the number of rows is selected in the range of 3-10. Yet, in further embodiments the injector may comprise more than 10 rows of nozzle holes.

The rotating embodiments of the fuel injector according to the invention also may comprise an impeller that is rigidly attached to the rotatable sleeve 1*a* in order to create forced flow conditions inside a combustion chamber when the sleeve rotates.

The invention covers any suitable actuator to drive the rotating parts of the fuel injector and any suitable actuator to drive the pilot valve's axial movements.

Figure 5:
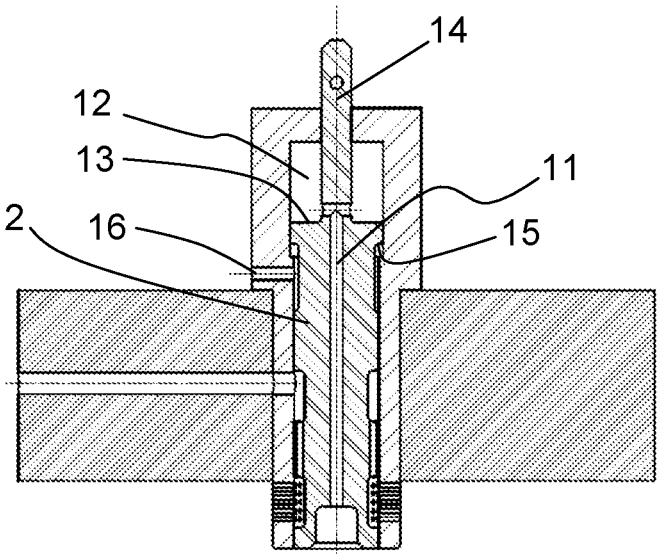
FIG. 5 is a schematic longitudinal section of an embodiment of a static fuel injector according to the invention comprising pressure balancing provisions.

So far, a distinction in reference numbers has been used to refer to the sleeve 1 and the pilot valve 2 of a static embodiment of the fuel injection device according to the invention as opposed to the sleeve 1*a* and pilot valve 2*a* of the rotatable embodiments of the fuel injection device. However, in the remainder of this descriptive section the reference numbers 1 and 1*a*, and the reference number 2 and 2*a* can be used interchangeably and can refer to respectively the sleeve and the pilot valve of either a static embodiment or a rotatable embodiment of the fuel injection device according to the invention. FIG. 5 is a schematic longitudinal section of an embodiment of a static fuel injector according to the invention comprising one or more pressure balancing provisions. In this embodiment these one or more pressure balancing provisions comprise a pressure balancing conduit 11 with one or more branches at its top end which fluidically connects the combustion chamber with the pressure balancing chamber 12 of the fuel injector. The pressure chamber comprises a first annular surface 13 through which the fluid in the pressure chamber exerts a force on the pilot valve 2 in the downward direction, i.e. the direction of the combustion chamber. In order to obtain an annular surface 13 with a surface area that is equal to the surface area of the pilot valve at the combustion chamber side of the pilot valve, the diameter of the pressure balancing chamber 12 is larger than the diameter of the pilot valve in order to compensate for the area of the pilot valve stem 14. The differential annular surface 15 at the bottom of the annular surface is connected to atmosphere by a vent 16 for venting and aeration.

Especially, a pressure balancing provision include one or more elements configured to balance the pressure. A pressure may be balanced when pressure differences are minimized or removed (pressure balance). For instance, the pressure difference may be smaller than 5% of the highest pressure, such as smaller than 2% of the highest pressure.

Figure 6:
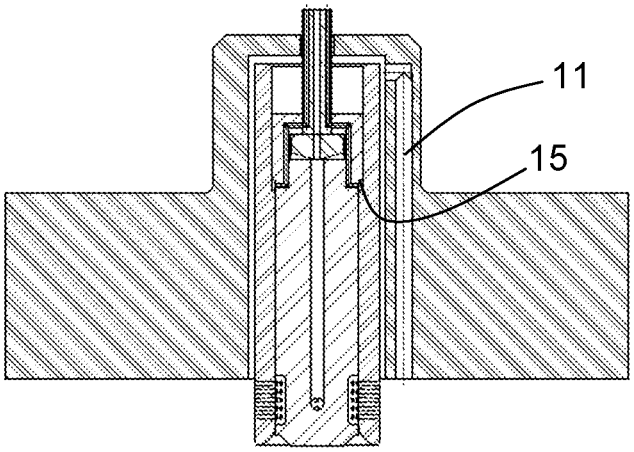
FIG. 6 is a schematic longitudinal section of an embodiment of a rotating fuel injector according to the invention comprising pressure balancing provisions.

FIG. 6 is a schematic longitudinal section of an embodiment of a rotating fuel injector according to the invention comprising pressure balancing provisions. In this embodiment the differential annular surface is aerated/vented through a conduit which runs along the pilot valve stem 14.

In the embodiments of the fuel injector according to the invention shown schematically in FIG. 5 and FIG. 6 the pressure balancing chamber 12 will be filled with gas. However, if for example the temperature of the gas would become a prohibitive factor, the invention also comprises embodiments in which the pressure balancing chamber 12 is filled with another fluid, such as for example fuel.

Figure 7:
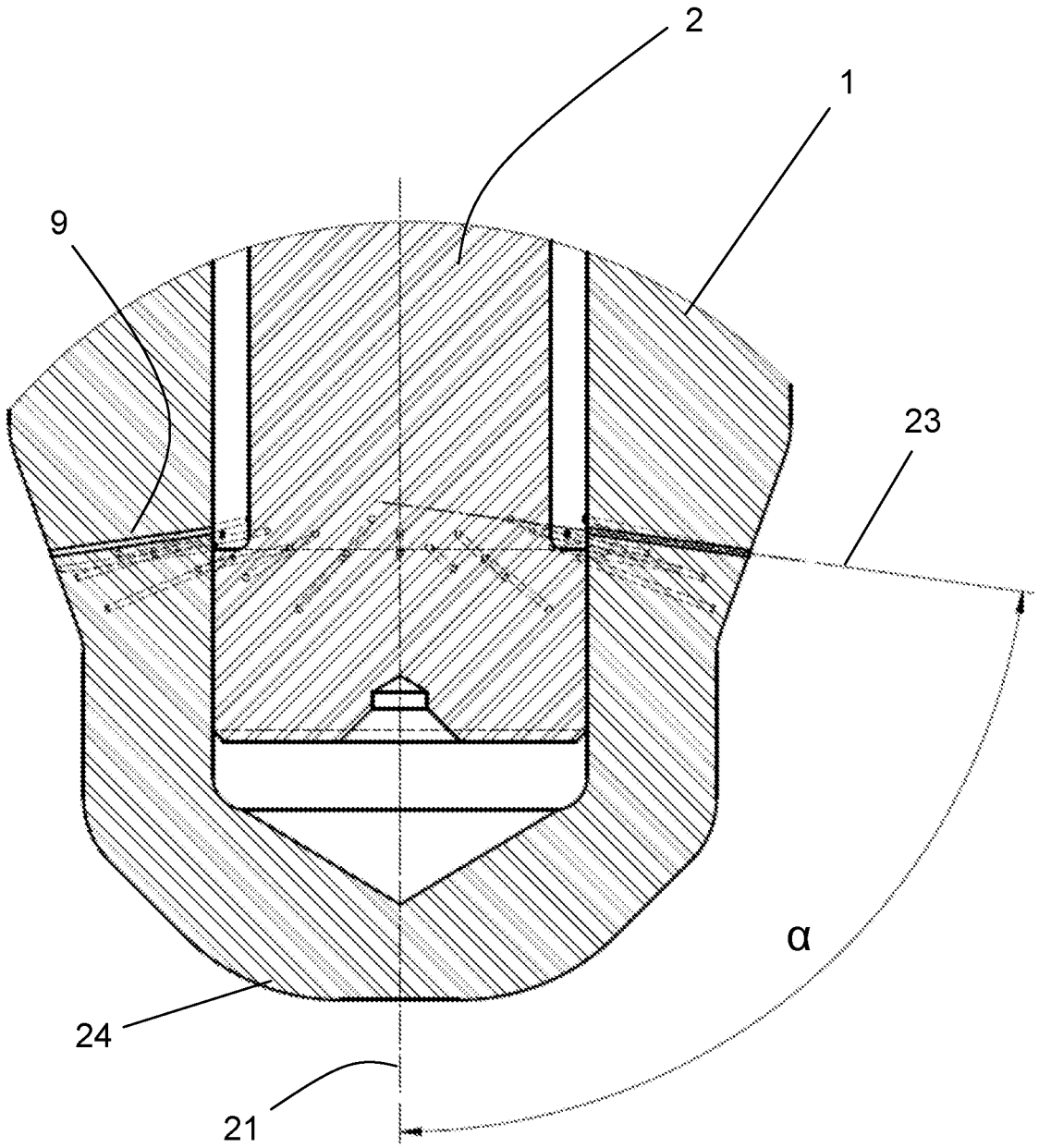
FIG. 7 is a schematic longitudinal section of an embodiment of a fuel injection device according to the invention in the vicinity of the tip of the device.

FIG. 7 is a schematic longitudinal section of an embodiment of a fuel injection device according to the invention in the vicinity of the tip of the device. Contrary to the embodiments discussed above, which comprise a sleeve 1 with an open end 24, the embodiment of the fuel injection device shown in FIG. 7 comprises a sleeve 1 with a closed tip at the end 24 of the sleeve that protrudes into a combustion chamber under normal operational conditions of the fuel injection device. In this embodiments the sleeve comprises a plurality of nozzle holes 9 wherein the angle $\alpha$ between the axis 21 of the sleeve and the axis 23 of the nozzle holes differs for each row of holes 9 in the sleeve 1. The invention also includes embodiments of the fuel injection device in which the angle α between the axis of a nozzle hole and the axis of the sleeve may differ from one hole to another hole in the same row of holes.

Figure 8:
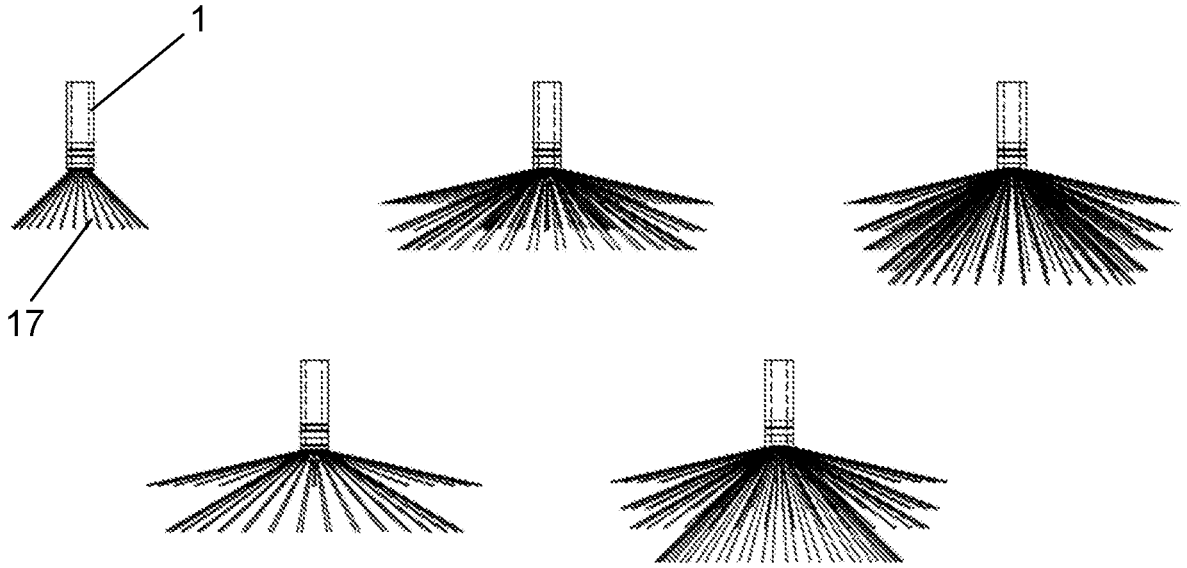
FIG. 8 is a schematic side view of the fuel spray pattern of an embodiment of the fuel injection device according to the invention under various fuel demand conditions.

FIG. 8 is a schematic side view of the fuel spray pattern of an embodiment of the fuel injection device according to the invention under various fuel demand conditions. The fan pattern of lines 17 represent the fuel jets injected through the nozzle holes 9 in the sleeve 1 of the fuel injection device. The images in FIG. 8 schematically represent from left to right the pattern when respectively one, two, three, four and five rows of nozzle holes 9 of a pilot valve type fuel injection device are opened. Especially, if a power demand of the combustion engine increases, the sleeve 2 may translate and more nozzle hole 9 are opened. The figure further schematically depicts nozzle holes 9 arranged in a staggered configuration, especially to minimize the required distance between two successive rows of nozzle holes, as can been seen from the pattern of the fuel jets (provided by nozzle holes arranged in different rows).

Figure 9:
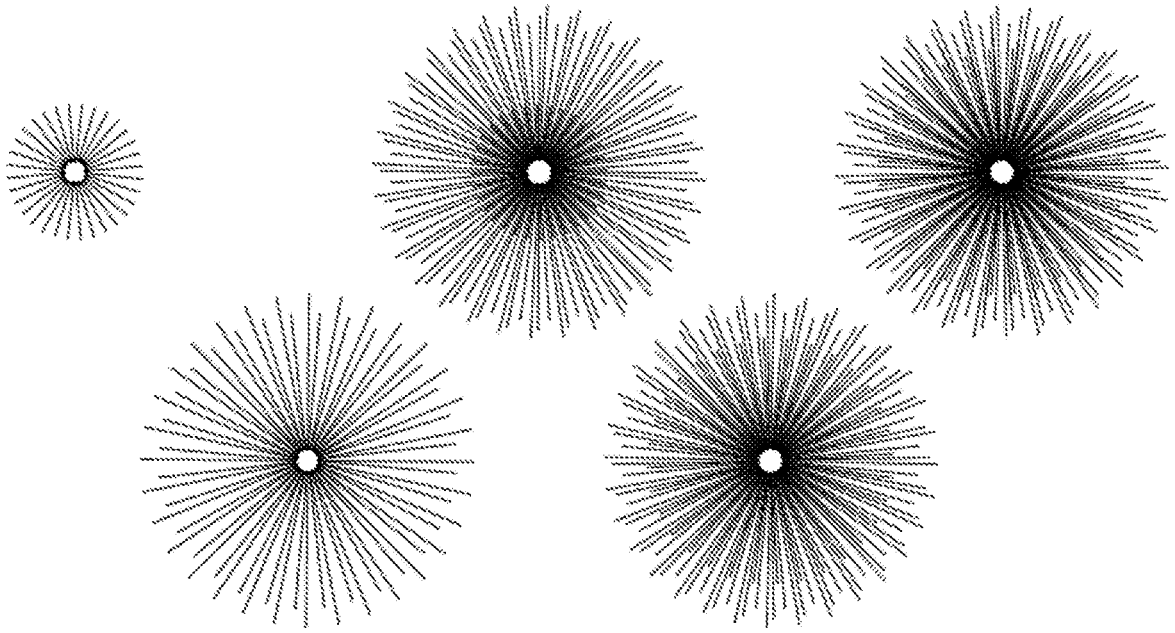
FIG. 9 is a schematic bottom view of the spray patterns shown in FIG. 8 in a side view.

FIG. 9 is a schematic bottom view of the spray patterns shown in FIG. 8 in a side view. The schematic spray patterns depicted in FIG. 9 show embodiments with an essentially radial orientation of the fuel jet streams injected through the fuel injector nozzle holes 9. Especially, the orientation of the longitudinal axis of the nozzle holes 9 is also essentially radial. Especially, a line extending the longitudinal axis of a nozzle 9 may intersect the longitudinal axis 21 of the sleeve 1. The invention also includes embodiments of the fuel injection device 20 in which the longitudinal axis of one or more of the nozzle holes 9 has a non-radial configuration.

All the embodiments of the fuel injector device shown in the appended drawings are of the type wherein the number of nozzle holes that is opened for fuel to be injected into a combustion chamber increases when the pilot valve 2 or 2*a* moves in the direction of the combustion chamber, i.e. the downward direction in the drawings, and the number of nozzle holes that is opened decreases when the pilot valve 2 or 2*a* moves in the opposite direction, i.e. the upward direction in the drawings. However, the invention includes embodiments wherein the number of nozzle holes that is opened for fuel to be injected into a combustion chamber increases when the pilot valve 2 or 2*a* moves away from the combustion chamber and decreases when the pilot valve moves in the direction of the combustion chamber As described above, the invention may especially be embodied in the following embodiments, wherein the embodiments are merely numbered for reference reasons.

1. An injection device for the injection of a fuel into the combustion chamber of an internal combustion engine, wherein the device comprises a sleeve (1,1*a*) and (pilot) valve (2,2*a*) which can move axially inside the sleeve.
2. The injection device according to embodiment 1, wherein the (pilot) valve (2,2*a*) comprises at least one fuel chamber (6,8,10).
3. The injection device according to embodiment 1 or 2, wherein the (pilot) valve (2,2*a*) comprises at least one fuel channel (7,4*a*).
4. The injection device according to any of the preceding embodiments, wherein the sleeve (1*a*) is rotatable during operation of the device.
5. The injection device according to any of the preceding embodiments, wherein the sleeve (1,1*a*) comprises one or more nozzle holes (9) in the vicinity of one end.
6. The injection device according to embodiment 5, wherein the angle between the longitudinal axis of at least one nozzle hole and the axis of the sleeve (1,1*a*) is in the range between 0 degrees and 90 degrees.
7. The injection device according to any of the preceding embodiments, wherein the (pilot) valve (2) comprises two fuel chambers (6,8) which are fluidically connected to each other by a fuel channel (7).
8. The injection device according to any of the preceding embodiments, wherein the device comprises an impeller which is rigidly connected to the sleeve (1*a*).
9. The injection device according to any of the preceding embodiments, wherein at least one of the nozzle holes (9) has a diameter of maximum 50 micrometers.
10. The injection device, according to any of the preceding embodiments, wherein at least one of the nozzle holes (9) has a diameter of maximum 30 micrometers.
11. The injection device according to any of the preceding embodiments, wherein the device comprises pressure balancing provisions.
12. The injection device according to any of the preceding embodiments, wherein the pressure balancing provisions comprise a pressure balancing conduit (11) and a pressure balancing chamber (12).

Especially, the present invention provides an improved fuel injection devices for internal combustion engines and to a system comprising an internal combustion engine comprising an improved fuel injection device. The improved fuel injector device according to the invention comprises a slidable valve instead of a needle valve principle. The valve does not comprise a seat, so, even in the case of a spring loaded embodiment of the valve there is no risk of hammering of the valve on a seat with the pertaining generation of noise. The improved fuel injector according to the invention allows a larger nozzle diameter and, therefore, a larger number of nozzle openings, if required or deemed useful. For rotating embodiments of the fuel injector according to the present invention, the valve or at least its spring, in the case of a spring loaded embodiment of the valve, can be located in the static section of the rotating fuel injector, thus eliminating the balancing problem of prior art rotating fuel injectors which comprise a spring in the rotating section.

The term "substantially" herein, such as in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to production process of operation or devices in operation.

While only certain features of the invention have been illustrated and described herein, many modifications and changes will occur to those skilled in the art. It is, therefore, to be understood that the appended claims are intended to cover all such modifications and changes as fall within the true spirit of the invention.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this application can be combined in order to provide additional advantages. Further, the person skilled in the art will understand that embodiments can be combined, and that also more than two embodiments can be combined. Furthermore, some of the features can form the basis for one or more divisional applications.

The priority document is incorporated herein.

The invention claimed is:

1. An injection device for the injection of a fuel into a combustion chamber of an internal combustion engine, wherein the device comprises a sleeve and a valve, and wherein the valve is configured slidable in an axial direction in the sleeve, wherein the sleeve comprises a number of stacked rows of nozzle holes, wherein the number of rows of nozzle holes is selected in the range of 3-10, wherein each row comprises an array of nozzle holes along a circumference of the sleeve, wherein the device is configured to control the number of rows of nozzle holes through which fuel may enter the combustion chamber by axially positioning the valve, wherein the device is configured for controlling a number of nozzle holes through which fuel may enter the combustion chamber dependent on a power demand, wherein the nozzle holes have a diameter selected equal to or less than 50 μm.

2. The device according to claim 1, wherein the valve comprises at least one fuel chamber.

3. The device according to claim 1, wherein the valve comprises at least one fuel channel.

4. The device according to claim 1, wherein the sleeve comprises a rotatable sleeve configured rotatably in the device about an axis of the rotatable sleeve.

5. The device according to claim 4, wherein the device comprises an impeller which is rigidly connected to the rotatable sleeve.

6. The device according to claim 1, wherein the valve comprises a rotatable valve configured rotatably in the device about an axis of the valve.

7. The device according to claim 1, wherein the sleeve comprises one or more nozzle holes in the vicinity of one end of the sleeve.

8. The device according to claim 1, wherein an angle (a) between a longitudinal axis of at least one nozzle hole and an axis of the sleeve is selected in the range of 0-90 degrees.

9. The device according to claim 1, wherein the valve comprises two fuel chambers and a fuel channel, wherein the fuel channel is configured in fluid contact with each of the two fuel chambers.

10. The device according to claim 1, wherein at least one of the nozzle holes has the diameter of less than or equal to 30 micrometers.

11. The device according to claim 1, wherein the device comprises one or more pressure balancing provisions.

12. The device according to claim 11, wherein the one or more pressure balancing provisions comprise a pressure balancing conduit and a pressure balancing chamber.

13. The device according to claim 1, wherein the valve is a pilot valve.

14. A system comprising an internal combustion engine, wherein the internal combustion engine comprises the injection device according to claim 1.

15. The system according to claim 14, comprising an actuator to drive the axial movement of the valve.

16. The injection device according to claim 1, wherein the injection device is configured to increase the number of nozzle holes that is opened for the fuel to be injected into the combustion chamber when the valve moves in a direction of the combustion chamber.

17. The injection device according to claim 1, wherein the injection device is configured to decrease the number of nozzle holes that is opened for the fuel to be injected into the combustion chamber when the valve moves in a direction of the combustion chamber.

* * * * *